US008061157B2

(12) United States Patent
Ayvazoglu

(10) Patent No.: US 8,061,157 B2
(45) Date of Patent: Nov. 22, 2011

(54) REFRIGERATOR

(75) Inventor: Cumhur Ayvazoglu, Istanbul (TR)

(73) Assignee: Arcelik A.S., Istanbul (TR)

( * ) Notice: Subject to any disclaimer, the term of this patent is extended or adjusted under 35 U.S.C. 154(b) by 433 days.

(21) Appl. No.: 12/159,596

(22) PCT Filed: Dec. 22, 2006

(86) PCT No.: PCT/EP2006/070140
§ 371 (c)(1),
(2), (4) Date: Jun. 27, 2008

(87) PCT Pub. No.: WO2007/077166
PCT Pub. Date: Jul. 12, 2007

(65) Prior Publication Data

US 2009/0031751 A1 Feb. 5, 2009

(30) Foreign Application Priority Data

Jan. 6, 2006 (TR) ..... A 2006 00100

(51) Int. Cl.

| | |
|---|---|
| ***F25C 5/18*** | (2006.01) |
| ***F25D 25/04*** | (2006.01) |
| ***G07F 9/02*** | (2006.01) |
| ***B65H 3/28*** | (2006.01) |
| ***B65H 1/08*** | (2006.01) |
| ***B65H 5/00*** | (2006.01) |
| ***A24F 15/04*** | (2006.01) |

(52) U.S. Cl. ..... 62/344; 222/447; 222/451; 221/150 R; 221/221; 221/222; 221/230; 221/231; 221/237; 221/254

(58) Field of Classification Search ..... 62/344; 222/447, 451; 221/221, 222, 230, 231, 237, 221/254
See application file for complete search history.

(56) References Cited

U.S. PATENT DOCUMENTS

| | | | | |
|---|---|---|---|---|
| 5,272,888 | A | 12/1993 | Fisher et al. | |
| 5,860,564 | A * | 1/1999 | Jablonski | 221/303 |
| 6,904,765 | B2 * | 6/2005 | Lee et al. | 62/320 |
| 2004/0237569 | A1 | 12/2004 | Lee et al. | |

FOREIGN PATENT DOCUMENTS

| | | | |
|---|---|---|---|
| EP | 1482262 | A | 12/2004 |
| NL | 1019654 | C1 | 6/2003 |

* cited by examiner

*Primary Examiner* — Judy Swann
*Assistant Examiner* — Filip Zec
(74) *Attorney, Agent, or Firm* — Venable, Campillo, Logan & Meaney PC

(57) ABSTRACT

A refrigerator is shown having a dosing unit for dispensing ice pieces one by one from an icemaker.

16 Claims, 3 Drawing Sheets

Figure 4:
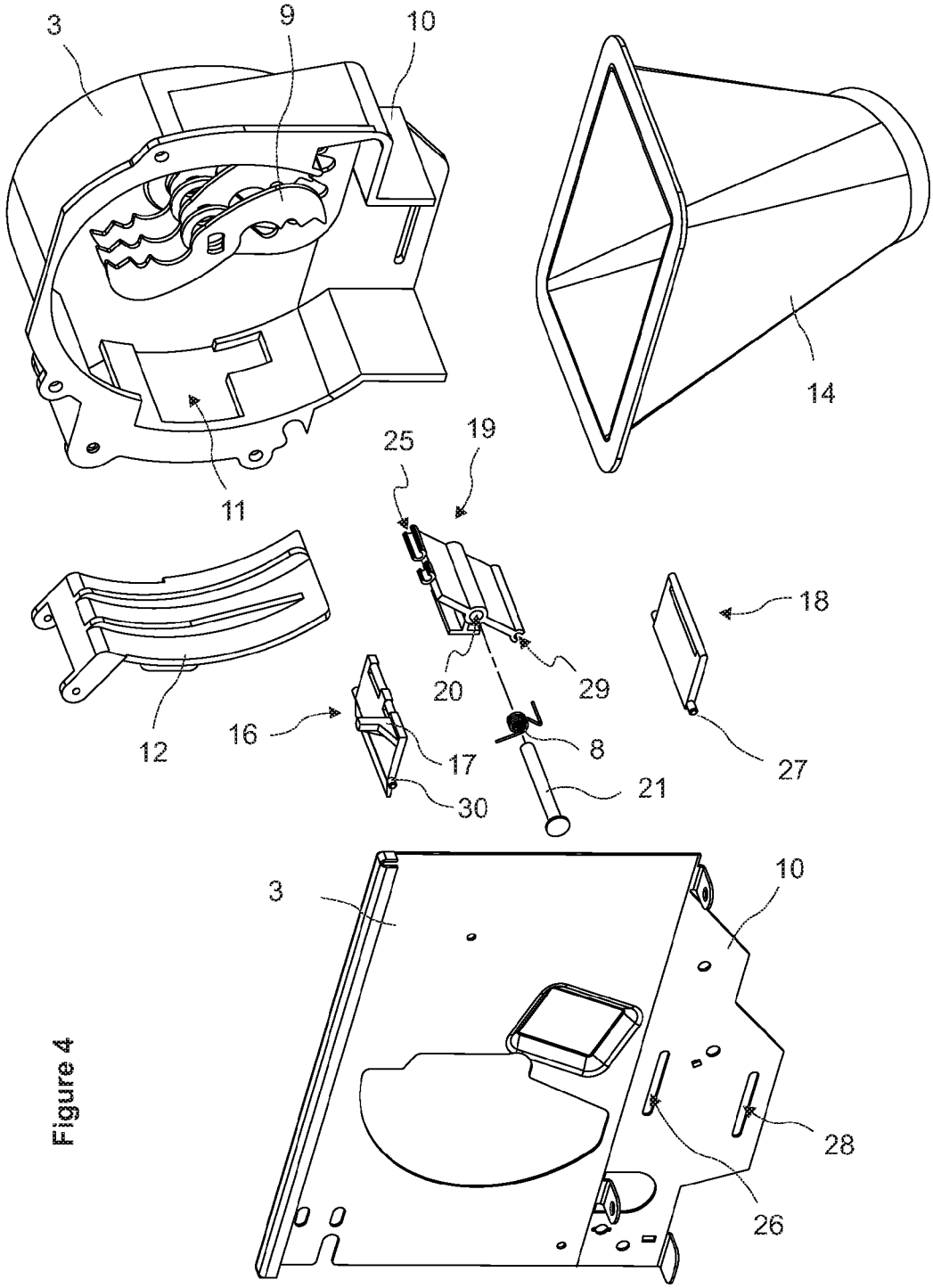

Figure 1
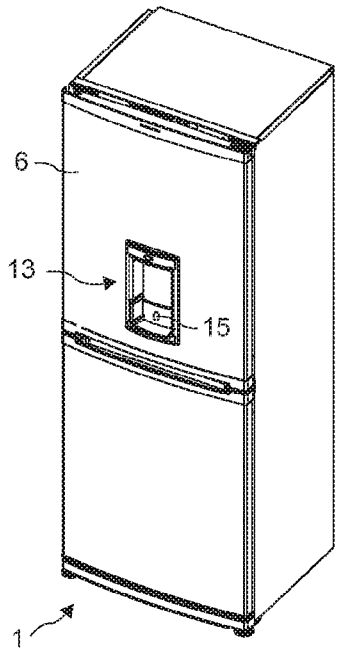
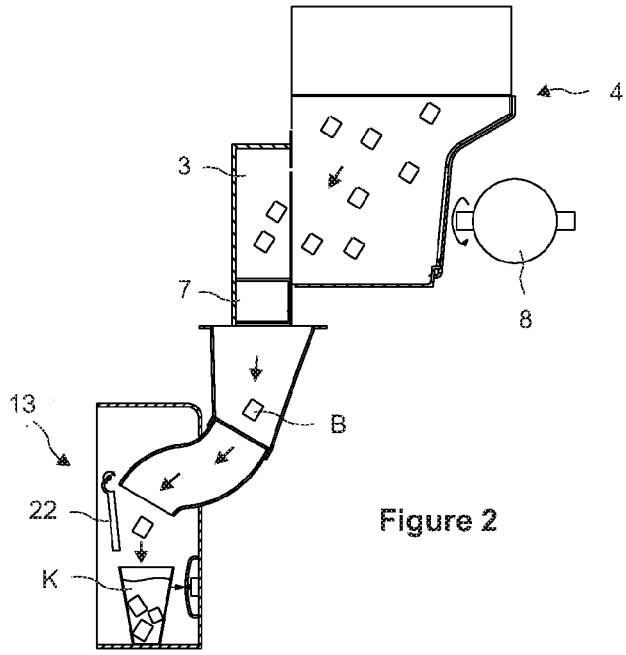
Figure 2
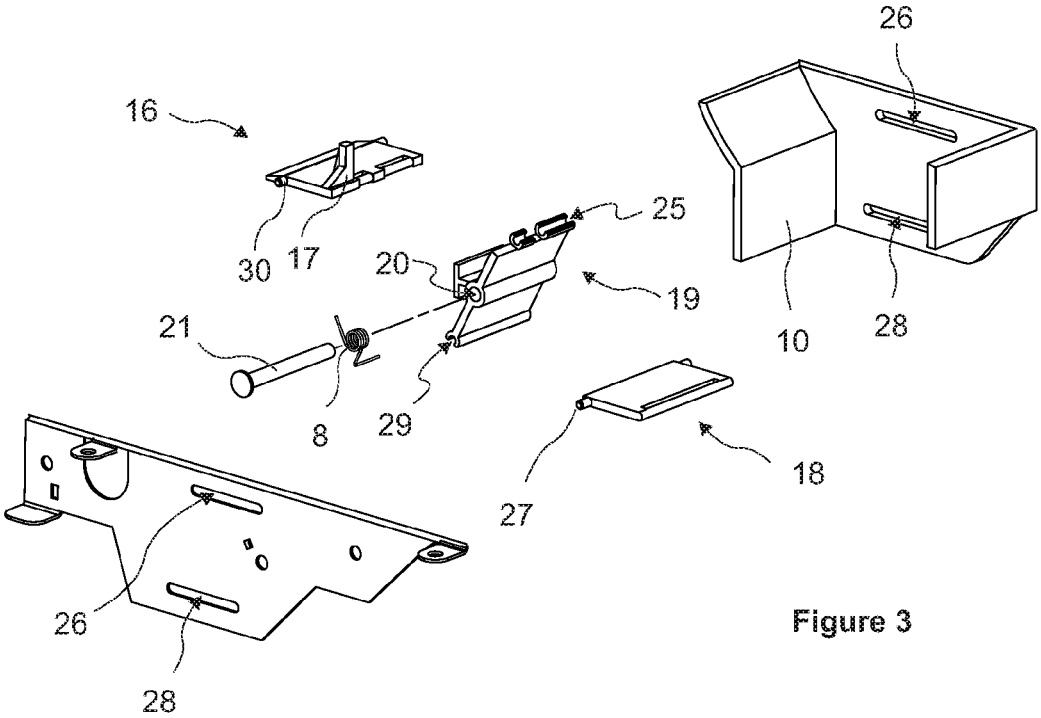
Figure 3

REFRIGERATOR

The present invention relates to a refrigerator comprising a dosaging unit that provides the ice pieces to be taken one by one.

In the freezer compartments of the refrigerators, providing to freeze food and beverages or store by freezing, there are icemakers that freeze the water, to be used as ice pieces when desired. In conventional applications, the ice pieces received from the icemaker can fall uncontrollably while transferring to the glass or container. Therefore, the user may encounter problems while taking out the ice. The ice pieces may come in more than the desired amount or the ice pieces can drop outside when the user takes away the container filled with the ice pieces.

In the state of the art Netherlands patent document no. NL1019654, the description is given for an ice dispensing device that can dose ice cubes one by one.

In the state of the art U.S. Pat. No. 3,572,053, the description is given for a refrigerator cabin including a freezer compartment with an access opening and a door for closing the access opening containing an icemaker, an ice storage receptacle and an ice dispenser on the freezer compartment door that can dose the ice pieces.

In the state of the art U.S. Pat. No. 4,102,660, the description is given for an actuator that actuates an ice dosaging apparatus for controlling the delivery of the ice pieces formed within a refrigerator cabin to the ice dispenser and a closure that functions together with the actuator, closing the end of the delivery chute when the apparatus does not operate.

The object of the present invention is to design a refrigerator comprising a dosaging unit that provides to deliver one by one the ice pieces formed therein.

The refrigerator designed to fulfill the object of the present invention is explicated in the first claim whereas its other features are explicated in the respective claims.

The refrigerator of the present invention comprises a dosaging unit that provides the ice pieces formed in an icemaker in the freezer compartment to be delivered automatically one by one to the containers placed in the ice dispenser. The ice pieces are received one by one into the dosaging unit and disposed in the pathway by moving an upper plate, a connection part and a lower plate together in a coordinated way.

In an embodiment of the present invention, while the ice pieces that get stuck to each other are separated by means of breakers situated in the dosaging unit, actuated by a motor, at the same time the upper plate is pushed, providing the upper plate, a connection part and a lower plate to receive the ice pieces one by one in a coordinated way and dispose in the pathway.

In this embodiment, during dosaging, while the breaker moves rotating around the shaft it is connected to the conveyer, it starts pushing the upper plate that is in its way, and as the upper plate moves, the connection part, attached with a joint thereto, dimensioned such that it is bigger than one ice piece but smaller than two adjacent ice pieces desired to be dosaged, is also activated. Since the connection part moves by rotating around a shaft, while the upper plate attached to it from the top side moves in one direction linearly, the lower plate, attached thereto with a joint, moves in the opposite direction. In the meantime, the pins of the upper plate and the lower plate are forced to move linearly in the upper pin channel and the lower pin channel respectively. Accordingly, with its clockwise and counterclockwise movement around the shaft, the upper and lower shutters provide the inlet and outlet to open or close for the passage of the ice pieces by moving forward and backward.

The refrigerator designed to fulfill the object of the present invention is illustrated in the attached drawings, where:

FIG. 1—is the perspective view of a refrigerator.

FIG. 2—is the schematic view of an icemaker, a dosaging unit, a pathway and an ice dispenser.

FIG. 3—is the exploded view of a dosaging unit.

FIG. 4—is the exploded view of an icemaker, a dosaging unit, and a pathway.

Figure 5:
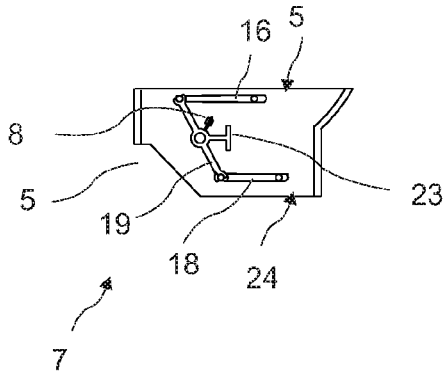

FIG. 5—is the schematic view of a dosaging unit.

Figure 6:
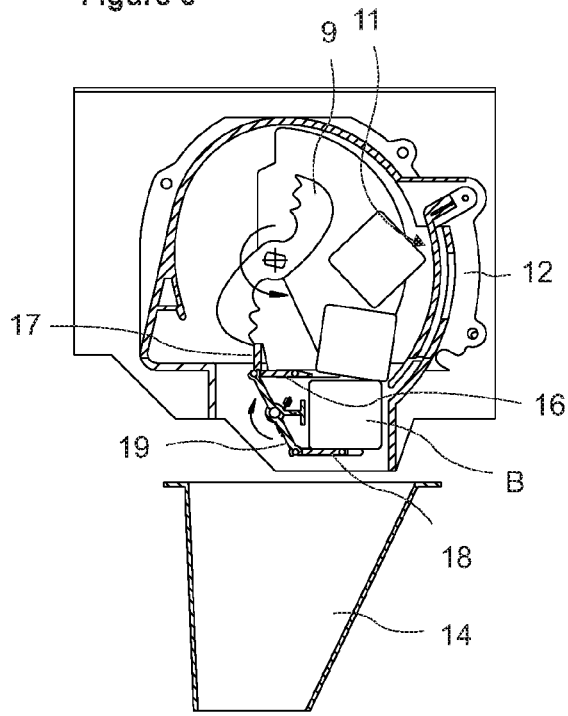

FIG. 6—is the schematic view of a dosaging unit when an ice piece is started to be received between the upper plate and the lower plate.

Figure 7:
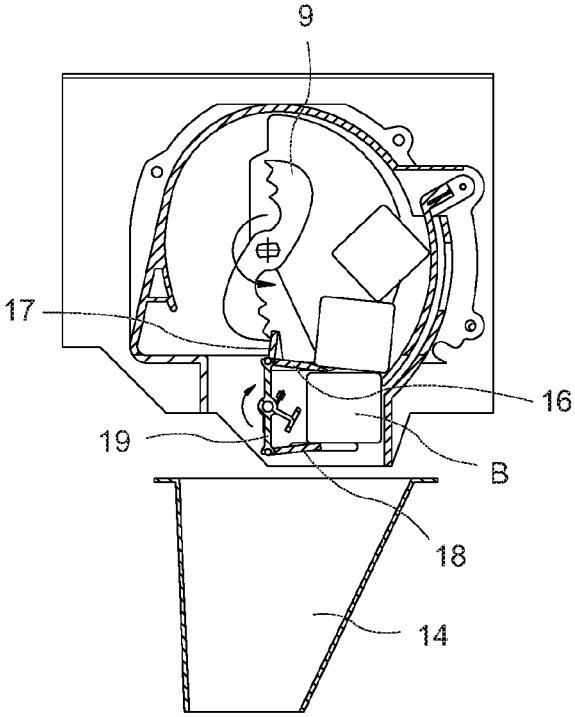

FIG. 7—is the schematic view of a dosaging unit when an ice piece is received between the upper plate and the lower plate.

Figure 8:
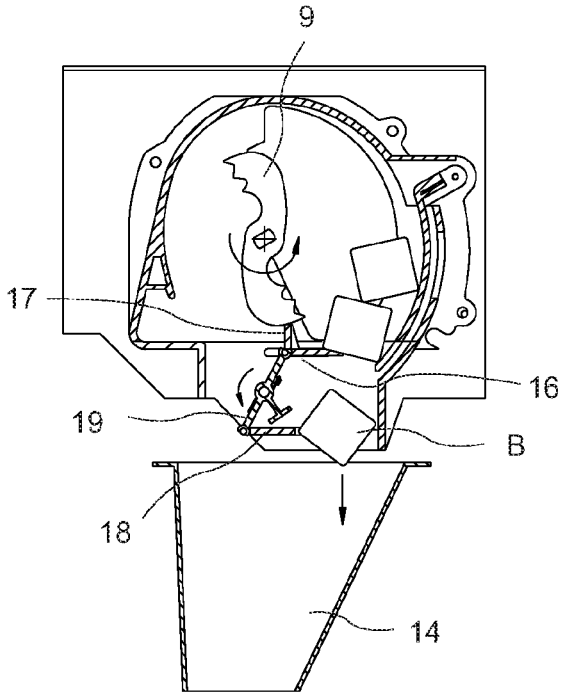

FIG. 8—is the schematic view of a dosaging unit when an ice piece between the upper plate and the lower plate is disposed in the pathway.

The elements illustrated in the figures are numbered as follows:

1. Refrigerator
2. Cabin
3. Ice chamber
4. Icemaker
5. Inlet
6. Door
7. Dosaging unit
8. Movement mechanism
9. Breaker
10. Body
11. Passage
12. Lid
13. Ice dispenser
14. Pathway
15. Actuator
16. Upper plate
17. Extension
18. Lower plate
19. Connection part
20. Shaft housing
21. Shaft
22. Protector
23. Regulator
24. Outlet
25. Upper bearing
26. Upper pin channel
27. Lower pin
28. Lower pin channel
29. Lower bearing
30. Upper pin
A—Container
B—Ice (piece)

The refrigerator (1) of the present invention comprises a cabin (2) wherein food and beverages are emplaned, one or more doors (6) providing access inside the cabin (2), an icemaker (4) situated inside the cabin (2) provided to form the ice pieces (B), an ice chamber (3) positioned under the icemaker (4), providing the formed ice pieces (B) formed in the icemaker (4) to be collected, dosaging unit (7) providing the ice pieces (B) received from the ice chamber (3) to be delivered to the desired containers (K) one by one, an ice dispenser (13) on the exterior surface of the door (6) allowing the user to transfer the ice pieces (B) to the desired container (K) and a pathway (14) situated under the dosaging unit (7), connecting the ice dispenser (13) with the dosaging unit The dosaging unit (7) comprises a body (10), an inlet (5) on the upper portion of the body (10), just under the ice chamber (3), an outlet (24) on the lower portion of the body (10), just above the pathway (14), an upper plate (16) situated at the inlet (5) providing the ice pieces (B) delivered to the ice chamber (3) to be taken one by one, when not desired preventing the ice pieces (B) to be delivered to the outlet (24), a lower plate (18) preventing the ice piece (B) to pass into the outlet (24) while the upper plate (16) allows the passage of the ice piece (B), and providing the ice piece (B) to be disposed in the outlet (24) after the upper plate (16) allows the passage of the ice piece (B), a connection part (19) attached to the upper plate (16) and the lower plate (18) from its opposite sides with itself in the middle, such that a "C" shape is formed allowing only one ice piece (B) to enter in between them, connected to the body (10) from its center such that it can rotate around, and moving the upper plate (16) and the lower plate (18) in their planes such that one goes forwards and the other backwards while rotating clockwise or counterclockwise around the axis it is attached, providing only one ice piece (B) to be taken between the upper plate (16) and the lower plate (18) and disposed in the outlet (24) and a movement mechanism (8) enabling the upper plate (16), the lower plate (18) and the connection part (19) to be activated and after being activated returning to their initial positions thus repeating the dosaging process.

In the embodiment of the present invention, when the user wants to take ice, he/she emplaces the container (K) in the chamber (3) and provides the ice pieces (B) to be driven into the dosaging unit (7). In the meantime, the upper plate (16) opens the inlet (5) and the lower plate (16) closes the outlet (24) while the inlet (5) is opened. Accordingly, the ice piece (B) on the upper plate (16) passes through the opened inlet (5) by itself with the force of gravity, and drops between the lower plate (18) and itself. After the ice piece (B) enters between the upper plate (16) and the lower plate (18), the upper plate (16) closes the inlet (5) and the lower plate (18) opens the outlet (24) simultaneously. Consequently, the received ice piece (B) is disposed into the pathway (14) from the outlet (24).

In an embodiment of the present invention, the movement mechanism (8) actuates the upper plate (16), the lower plate (18) and the connection part (19) by a motor and brings them to their initial positions.

In another embodiment of the present invention, the dosaging unit (7) comprises a regulator (23) on the connection part (19), providing the ice piece (B) received between the connection part (19), the upper plate (16) and the lower plate (18) to be pushed and inserted therebetween without being squeezed in.

By way of this embodiment, the ice piece (B) that drops in between the connection part (19), the upper plate (16) and the lower plate (18) is provided to be emplaced in accordance with its shape and the ice piece (B) is prevented from being squeezed in during dosaging.

In another embodiment of the present invention, the dosaging unit (7) comprises one or more breakers (9), actuated by the movement mechanism (8), providing to break the ice pieces (B) that get stuck to each other and an extension (17) situated on the upper plate (16), that is pushed by the breaker (9) by getting in contact while moving and providing to move the upper plate (16).

In this embodiment, the breaker (9) prevents the ice pieces (B) from getting stuck to each other that are delivered to the dosaging unit (7) by being activated by the movement mechanism (8), and breaks up the stuck ones. Furthermore, as it turns, it pushes the extension (17) together, that is emplaned to be in front of it as it turns. The pushed extension (17) moves the upper plate (16), thus the connection part (19) and the lower plate (18) together with itself. Consequently, the upper plate (16), the connection part (19) and the lower plate (18) are coordinately enabled to dispose the ice pieces (B) one by one in the pathway (14).

In this embodiment, while the breaker (9) is turned by the movement mechanism (8), it pushes the extension (17) together with itself and the extension (17) moves the upper plate (16), the connection part (19) and the lower plate (18) together with itself. The moved connection part (19) is returned to its initial position by turning in the opposite direction by a spring shaped other movement mechanism.

In another embodiment of the present invention, the dosaging unit (7) furthermore comprises a shaft housing (20) at the center of the connection part (19), an upper bearing (25) providing the upper plate (16) with one side emplaced therein to be rotatably housed by the connection part (19), a lower bearing (29) providing the lower plate (18) with one side emplaced therein to be rotatably housed by the connection part (19), a shaft (21) providing the connection part (19) to be attached to the body (10) by being inserted in the shaft housing (20), and also enabling the connection part (19) to move by rotating around it, an upper pin (30) situated on the upper plate (16), an upper pin channel (26) situated on the body (10) providing the upper pin (30) moving inside to transfer the rotational movement of the connection part (19) to the upper plate (16) as a linear movement, a lower pin (27) situated on the lower plate (18), a lower pin channel (28) situated on the body (10) providing the lower pin (27) moving inside to transfer the rotational movement of the connection part (19) to the lower plate (18) as a distancing movement (FIG. 4).

In this embodiment, while the breaker (9) moves by rotating around its axis without contacting the extension (17), the movement mechanism (8) provides the upper plate (16) to resume its initial position and the upper plate (16) allows one ice piece (B) that escapes the breakers (9) to enter between itself and the lower plate (18). When the breaker (9) encounters the extension (17), after rotating about its rotational axis, it continues its rotational movement and at the same time pushes the extension (17) along with itself as it moves. Consequently the extension (17) moves the upper plate (16), the upper plate (16) moves the connection part (19) and the connection part (19) moves the lower plate (18). In the meantime, while the upper plate (16) goes in one direction, the lower plate (18) moves in the opposite direction because of the connection part (19) and opens the path for the ice piece (B) inside, allowing it to drop into the pathway (14). Simultaneously, the upper plate (16) resumes a position that prevents a new ice piece (B) to enter between the upper plate (16) and the lower plate (18). When the extension (17) gets free from the breaker (9), the upper plate (16) starts to move in the opposite direction by means of the spring and returns to its initial position. While the upper plate (16) returns to its initial position allowing a new ice piece to be received between the upper plate (16) and the lower plate (18), the lower plate (18) moves in the opposite direction resuming its initial position such that the ice piece (B) received in between is prevented from dropping and positions itself under the ice piece (B) (FIG. 6, FIG. 7, FIG. 8).

In an embodiment of the present invention, the dosaging unit (7) comprises a passage (11) that allows the ice pieces (B) to pass into the body (10) and a lid (12) that provides the passage (11) to be opened or closed.

In this embodiment, the ice pieces (B) that drop into the ice chamber (3) from the icenaker (4) enter the dosaging unit (7) by passing through the passage (11) opened by the lid (12).

In an embodiment of the present invention, the ice dispenser (13) comprises a protector that provides the exit of the pathway (14) to be closed, and opened by the weight of the ice piece (B) dropping down from the pathway (14), closing after the ice piece (B) drops down by means of a spring hinge, preventing the pathway (14) to be affected by the temperature of the exterior environment and an actuator (15) on the ice dispenser (13), providing to actuate the movement mechanism (8) in the ice dispenser (13) by sensing a container (K) has been emplaced therein.

In this embodiment of the present invention, the user emplaces the container (K) in the ice dispenser (13) when he/she desires to take out ice (B). The user provides the actuator (15) to actuate the movement mechanism (8) by emplacing the container (K) in the ice dispenser (13). In the meantime, the breakers (9) that move actuate the upper plate (16), the connection part (19) and the lower plate (19), providing the broken ice pieces (B) to be disposed into the pathway (14).

By means of the present invention, the desired amount of ice pieces (B) can be delivered without manual intervention or without using tools like a pair of tongs, in single pieces. After the process of taking out the ice pieces (B) is finished, the dropping of extra ice pieces (B) into the dosaging unit (7) or out of the refrigerator (1) can be prevented. Since the ice pieces (B) are taken in a controlled manner, savings can be maintained.

The invention claimed is:

1. A refrigerator comprising an icemaker for forming ice pieces, an ice chamber positioned under the icemaker, providing the formed ice pieces to be collected, a dosaging unit providing the ice pieces received from the ice chamber to be delivered to the desired containers, an ice dispenser allowing the user to deliver the ice pieces to the desired container and a pathway situated under the dosaging unit, connecting the ice dispenser with the dosaging unit, delivering the ice pieces received from the dosaging unit to the ice dispenser and wherein the dosaging unit has a body, an inlet on the upper portion of the body located under the ice chamber, an outlet on the lower portion of the body, located above the pathway, a loading position in which an upper plate is situated at the inlet providing the ice pieces delivered to the ice chamber to be taken one by one and preventing the ice pieces to be delivered to the outlet, when not desired, a lower plate preventing the ice piece to pass into the outlet while the upper plate allows the passage of the ice piece, and providing the ice piece to be disposed in the outlet after the upper plate allows the passage of the ice piece a connection part directly attached to the upper plate and the lower plate, the upper plate and the lower plate being arranged in parallel spaced planes, wherein the movement of each plate is co-planar allowing only one ice piece to enter in between them; the connection part attached to the body at a center of said connection part such that the connection part rotates around said center, while moving the upper plate and the lower plate in opposite directions, thereby allowing the disposed ice piece into the outlet or dispensing the ice piece from the outlet; and a movement mechanism returning the upper plate, the lower plate and the connection part from a dispensing position to said loading position, thus repeating a dosaging process.

2. The refrigerator as in claim 1, wherein the dosaging unit comprising a regulator on the connection part providing the ice piece received between the connection part, the upper plate and the lower plate to be pushed and inserted therebetween without being squeezed in.

3. The refrigerator as in claim 2, wherein the dosaging unit comprises one or more breakers, actuated by the movement mechanism, providing to break the ice pieces that get stuck to each other and an extension situated on the upper plate, that is pushed by the breaker by contacting while moving, and providing to actuate the upper plate.

4. The refrigerator as in claim 3, wherein the dosaging unit comprises a shaft housing at the center of the connection part, an upper bearing providing the upper plate with one side emplaced therein to be rotatably housed by the connection part, a lower bearing providing the lower plate with one side emplaced therein to be rotatably housed by the connection part, a shaft providing the connection part to be attached to the body by being inserted in the shaft housing, and also the connection part to move by rotating around it, an upper pin situated on the upper plate, an upper pin channel situated on the body providing the upper pin moving inside to transfer the rotational movement of the connection part to the upper plate as a linear movement, a lower pin situated on the lower plate, a lower pin channel situated on the body providing the lower pin moving inside to transfer the rotational movement of the connection part to the lower plate as a distancing movement.

5. The refrigerator as in claim 4, wherein the ice dispenser comprises a protector that provides the exit of the pathway to be closed, and opened by the weight of the ice piece dropping down from the pathway, closing after the ice piece drops down by means of a spring hinge, preventing the pathway to be affected by the temperature of the exterior environment and an actuator on the ice dispenser, providing to actuate the movement mechanism in the ice dispenser by sensing a container has been emplaced therein.

6. The refrigerator as in claim 1, wherein the dosaging unit comprises one or more breakers, actuated by the movement mechanism, providing to break the ice pieces that get stuck to each other and an extension situated on the upper plate, that is pushed by the breaker by contacting while moving, and providing to actuate the upper plate.

7. The refrigerator as in claim 6, wherein the dosaging unit comprises a shaft housing at the center of the connection part, an upper bearing providing the upper plate with one side emplaced therein to be rotatably housed by the connection part, a lower bearing providing the lower plate with one side emplaced therein to be rotatably housed by the connection part, a shaft providing the connection part to be attached to the body by being inserted in the shaft housing, and also the connection part to move by rotating around it, an upper pin situated on the upper plate, an upper pin channel situated on the body providing the upper pin moving inside to transfer the rotational movement of the connection part to the upper plate as a linear movement, a lower pin situated on the lower plate, a lower pin channel situated on the body providing the lower pin moving inside to transfer the rotational movement of the connection part to the lower plate as a distancing movement.

8. The refrigerator as in claim 7, wherein the ice dispenser comprises a protector that provides the exit of the pathway to be closed, and opened by the weight of the ice piece dropping down from the pathway, closing after the ice piece drops down by means of a spring hinge, preventing the pathway to be affected by the temperature of the exterior environment and an actuator on the ice dispenser, providing to actuate the movement mechanism in the ice dispenser by sensing a container has been emplaced therein.

9. The refrigerator as in claim 6, wherein the ice dispenser comprises a protector that provides the exit of the pathway to be closed, and opened by the weight of the ice piece dropping down from the pathway, closing after the ice piece drops down by means of a spring hinge, preventing the pathway to be affected by the temperature of the exterior environment and an actuator on the ice dispenser, providing to actuate the movement mechanism in the ice dispenser by sensing a container has been emplaced therein.

10. The refrigerator as in claim 2, wherein the dosaging unit comprises a shaft housing at the center of the connection part, an upper bearing providing the upper plate with one side emplaced therein to be rotatably housed by the connection part, a lower bearing providing the lower plate with one side emplaced therein to be rotatably housed by the connection part, a shaft providing the connection part to be attached to the body by being inserted in the shaft housing, and also the connection part to move by rotating around it, an upper pin situated on the upper plate, an upper pin channel situated on the body providing the upper pin moving inside to transfer the rotational movement of the connection part to the upper plate as a linear movement, a lower pin situated on the lower plate, a lower pin channel situated on the body providing the lower pin moving inside to transfer the rotational movement of the connection part to the lower plate as a distancing movement.

11. The refrigerator as in claim 10, wherein the ice dispenser comprises a protector that provides the exit of the pathway to be closed, and opened by the weight of the ice piece dropping down from the pathway, closing after the ice piece drops down by means of a spring hinge, preventing the pathway to be affected by the temperature of the exterior environment and an actuator on the ice dispenser, providing to actuate the movement mechanism in the ice dispenser by sensing a container has been emplaced therein.

12. The refrigerator as in claim 1, wherein the dosaging unit comprises a shaft housing at the center of the connection part, an upper bearing providing the upper plate with one side emplaced therein to be rotatably housed by the connection part, a lower bearing providing the lower plate with one side emplaced therein to be rotatably housed by the connection part, a shaft providing the connection part to be attached to the body by being inserted in the shaft housing, and also the connection part to move by rotating around it, an upper pin situated on the upper plate, an upper pin channel situated on the body providing the upper pin moving inside to transfer the rotational movement of the connection part to the upper plate as a linear movement, a lower pin situated on the lower plate, a lower pin channel situated on the body providing the lower pin moving inside to transfer the rotational movement of the connection part to the lower plate as a distancing movement.

13. The refrigerator as in claim 12, wherein the ice dispenser comprises a protector that provides the exit of the pathway to be closed, and opened by the weight of the ice piece dropping down from the pathway, closing after the ice piece drops down by means of a spring hinge, preventing the pathway to be affected by the temperature of the exterior environment and an actuator on the ice dispenser, providing to actuate the movement mechanism in the ice dispenser by sensing a container has been emplaced therein.

14. The refrigerator as in claim 3, wherein the ice dispenser comprises a protector that provides the exit of the pathway to be closed, and opened by the weight of the ice piece dropping down from the pathway, closing after the ice piece drops down by means of a spring hinge, preventing the pathway to be affected by the temperature of the exterior environment and an actuator on the ice dispenser, providing to actuate the movement mechanism in the ice dispenser by sensing a container has been emplaced therein.

15. The refrigerator as in claim 2, wherein the ice dispenser comprises a protector that provides the exit of the pathway to be closed, and opened by the weight of the ice piece dropping down from the pathway, closing after the ice piece drops down by means of a spring hinge, preventing the pathway to be affected by the temperature of the exterior environment and an actuator on the ice dispenser, providing to actuate the movement mechanism in the ice dispenser by sensing a container has been emplaced therein.

16. The refrigerator as in claim 1, wherein the ice dispenser comprises a protector that provides the exit of the pathway to be closed, and opened by the weight of the ice piece dropping down from the pathway, closing after the ice piece drops down by means of a spring hinge, preventing the pathway to be affected by the temperature of the exterior environment and an actuator on the ice dispenser, providing to actuate the movement mechanism in the ice dispenser by sensing a container has been emplaced therein.

* * * * *